United States Patent [19]

Jozat

[11] 3,955,894

[45] May 11, 1976

[54] TUBULAR WRITING PEN

[75] Inventor: Walter Jozat, Bad Bramstedt, Germany

[73] Assignee: Koh-I-Noor Rapidograph, Inc., Bloomsbury, N.J.

[22] Filed: Feb. 26, 1975

[21] Appl. No.: 553,412

[30] Foreign Application Priority Data

Mar. 14, 1974 Germany ..... 2412210

[52] U.S. Cl. ..... 401/259

[51] Int. Cl. ..... B43k 1/10

[58] Field of Search..... 401/258–260, 217, 276, 401/132–135

[56] References Cited

UNITED STATES PATENTS

| | | | |
|---|---|---|---|
| 3,418,058 | 12/1968 | Gossel | 401/259 |
| 3,734,633 | 5/1973 | Anderka | 401/259 |
| 3,788,754 | 1/1974 | Glasa | 401/135 |

*Primary Examiner*—Lawrence Charles
*Attorney, Agent, or Firm*—David H. Semmes

[57] ABSTRACT

A tubular or stylus pen of the type comprising a cylindrical body provided with an axial inner bore, having at its front end a writing tube and an outer surface defining an ink equalizing chamber, further including a casing element with a portion receivably mounted upon the cylindrical body and adapted for sealing the ink equalizing chamber, wherein the improvement comprises a tubular extension upon the cylindrical body, extending rearwardly and connecting the cylindrical body and the ink supply chamber, the tubular extension together with the casing element defining means to allow the tubular extension to be moved forward to a limited extent within said casing element to thereby expose the ink equalizing chamber on the outer surface of the cylindrical body for cleaning without a complete disassembly of the pen.

9 Claims, 2 Drawing Figures

TUBULAR WRITING PEN

BACKGROUND OF THE INVENTION

Previous tubular writer constructions, such as German Pat. No. 1,561,856 employ a cylindrical body which is screwed into the front of a casing element. The casing element is open in the rear and has a ring shaped stop upon which the ink supply chamber, especially and typically an ink cartridge, can be placed. The ink therefore enters the casing element from the rear and then flows through the inside bore of the cylindrical body to the writing tube.

Cleaning of the cylindrical body, and particularly of the ink compensating chamber, in such previously known tubular writers required that the cylindrical body be screwed out in a forward direction from the casing or sleeve element. According to experience this was a difficult procedure since drying ink gums up the threads used for fastening of the cylindrical body and the casing element together. As a result the screwing out of the cylindrical body could often be carried out only with great difficulty. Moreover, the relatively sensitive cylindrical bodies of these types of tubular writers would have to be unscrewed from the casing element for the purpose of cleaning and separately cleaned as an individual part. During such a cleaning operation one must also be careful that the tubular writer is held and maintained in an essentially perpendicular position, so that the ink held within both the ink supply chamber and the inside space of the casing element will not run out whenever the cylindrical body must be removed from the casing element for cleaning.

Another known tubular writer construction is exampled by German Pat. No. 2,010,355, which corresponds to U.S. Pat. No. 3,734,633, where the cylindrical body is developed in one piece so as to house the ink supply chamber, and the casing element covering up the ink compensating chamber is removable in a foward direction from the cylindrical body. Because this casing element can be removed in a forward direction, a relatively simple exposure and cleaning of the ink compensating chamber is possible, without any particular difficulties as a result of ink which is still present in the ink supply chamber. The ink supply chamber remains connected with the rear end of the cylindrical body during this cleaning process so that no ink can flow from it and merely the ink compensating chamber is exposed.

The remaining difficulty, or disadvantage, in the case of this second known tubular writer construction consists essentially in the fact that a complete disassembling of the tubular writer is required in order to clean the ink compensating chamber. As a result this requires handling and manipulation of two completely separate parts, namely the cylindrical body and the casing element.

SUMMARY OF THE INVENTION

It is an object of the present invention to create a tubular writer which makes possible a simple cleaning of the ink compensating chamber without the necessity of completely disassembling it into two parts separate for this purpose.

According to one feature of this invention this cleaning task will be solved for a tubular writer of the initially mentioned type through a particularly advantageous structure. The cylindrical body has a tubeshaped attachment which projects beyond the rear end of the casing element when it is in a position over the forward end of the cylindrical body so as to completely cover the ink compensation or equalization chamber. This tube-shaped attachment communicates the inside bore with the ink supply chamber. As a result the cylindrical body is moveable forward along the axis of the casing element, in a limited way, in order to expose the ink compensating chamber. Preferably the axial length of the threaded tubular extension corresponds to about the axial length of the ink chamber.

In the case of the tubular writer according to the invention, the cylindrical body is thus connected with the ink supply chamber through the tubular attachment as an extension thereof. When the cylindrical body is completely covered by the casing element, an axial distance exists between the rear end of this casing element and the front edge of the ink supply chamber. The cylindrical body can be moved forward by this distance through the casing element, whereby the ink compensating chamber extends in front from the casing element, readily exposed for the purpose of cleaning.

According to a preferred embodiment, the tubular attachment has an outside thread which engages with a corresponding inside thread on the casing element which lies behind the area of the casing element adapted for covering up the ink compensating chamber. As a result the tubular attachment can be advanced through a screwing movement relative to the casing element. As a result the ink compensating chamber is exposed simply by screwing the tubular attachment forwardly into the casing element for the purpose of cleaning.

In order to prevent the cylindrical body from being moved out of the casing element when returned in a rearward direction, the outside diameter of the threaded tubular attachment can be smaller than the minimum outside diameter of the area of the cylindrical body housing the ink compensating chamber; a stop will result perforce in the inside space of the casing element which limits the rearward movement of the cylindrical body within and relative to the casing element.

In order to further simplify removal of the cylindrical body from the casing element, the area of the cylindrical body defining the ink compensating chamber can be developed with a widening diameter towards the front, so as to form a truncated cone. Then the inside space of the casing element is similarly adapted to this truncated cone shape. This feature has the further advantage that a relatively slight axial movement of the cylindrical body is sufficient to achieve complete separation of the cylindrical body from the inside wall of the casing element, thereby by further forward movement, no further difficulties develop.

The invention will be explained in more detail in the following pages on the basis of the figures showing an embodiment by way of example.

Additional objects, features and advantages of the present invention will be more readily apparent from the following detailed description of an embodiment thereof when taken together with the accompanying drawings.

DESCRIPTION OF PREFERRED EMBODIMENT

Figure 1:
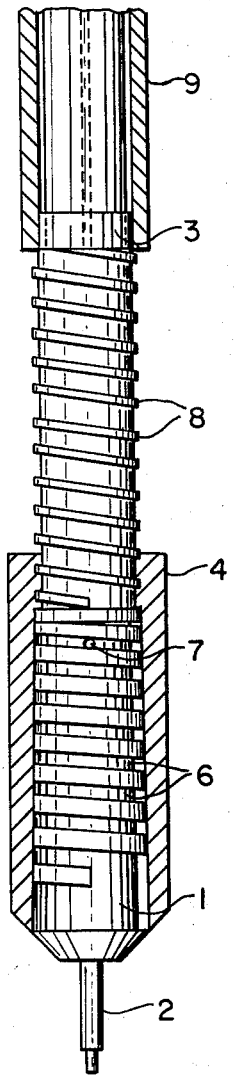
FIG. 1 schematically shows a section view of a tubular writer according to the invention with the cylindrical body being in writing position.

The tubular writer as shown has a cylindrical body 1 into the front of which a writing tube 2 is inserted. As is conventional, there is a bore inside this cylindrical body, with a falling weight attached to a cleaning wire for projecting into the writing tube, (not shown). In the forward (front) area the cylindrical body carries the ink compensating chamber 6 which in this case has the form of a spiral and which is in turn in communication with the inside bore of the cylindrical body 1 by way of a transverse bore 7.

A tube shaped attachment or extension 3 extends rearwardly of the area of the cylindrical body 1 which carries the ink compensating chamber 6, the diameter of said attachment being illustrated as smaller than the diameter of the forward area of the cylindrical body 1. This tube shaped attachment has an outside thread 8 of a relatively coarse pitch and includes within itself an ink passage or bore connected at one end with the inside bore of the cylindrical body 1 and at the other end with an ink supply chamber; shown as consisting of an ink cartridge 9. This ink cartridge 9 may be placed, as shown, in a sealing manner onto the rear end of the tubeshaped attachment 3.

The cylindrical body 1 together with its tubeshaped attachment 3 is inserted and threadingly engaged into a casing element 4. The casing element is shown with an interior surface having a truncated slightly cone-shaped configuration, so that the points of the shoulders defining the spiral shaped ink compensating chamber 6 sealingly abut; according to the position of FIG. 1. At the rear area of the casing element 4 an inside thread has been provided for the receiption of the mating exterior thread 8 which is provided on the outside of the tube shaped attachment 3.

As can be seen easily from the figures, the tube shaped attachment 3 extends rearward beyond the casing element 4, in the case of the cylindrical body 1 being in writing position according to FIG. 1. As shown in FIG. 1, between the rear edge of the casing element and the front edge of the ink cartridge 9 there is a distance which corresponds to about the axial length of the ink compensating chamber 6.

Figure 2:
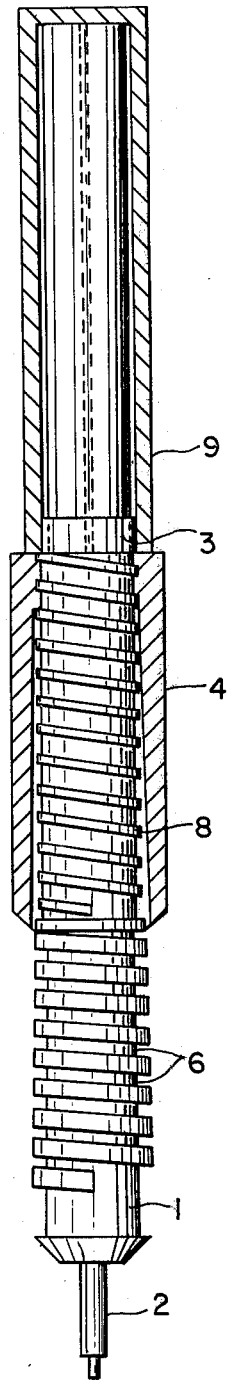
FIG. 2 shows the tubular writer from FIG. 1 with an exposed ink compensating chamber.

Whenever the ink compensating chamber 6 is to be exposed for the purpose of cleaning the tube shaped attachment 3 is screwed further forward into the casing element 4 until the front edge of the ink cartridge 9 abuts against the rear edge of the casing element 4. In that case the position according to FIG. 2 will result, and the ink compensating chamber 6 is therefore completely exposed and can thus be cleaned in a most simple manner. After this cleaning, the tube shaped attachment 3 is screwed rearwardly until the transition area of the cylindrical body and the tube shaped attachment contacts an annular stop formed within the casing element 4. Then the cylindrical body is again in the position according to FIG. 1 and the tubular writer is ready for writing.

As has already been mentioned, the front or forward interior surface of the casing element 4 is developed in the form of a truncated cone and the shoulders defining the ink compensating chamber spiral are formed correspondingly. As a result, after only a short axial movement of the tubular attachment 3 in a forward direction the cylindrical body 1 is removed from contact with the inside wall of the casing element 4, and can be moved forward without further impediment from dried ink.

In the event that a complete disassembly, including separation of the casing element 4 from the cylindrical body 1, is necessary, this also is accomplished easily according to the present invention. The ink cartridge 9 is removed and the tubular attachment 3 is screwed out and removed from the casing element 4 in a forward direction. It is further contemplated that the cylindrical body 1 and the tubular attachment 3 can be separable from one another in order to make the inside bore of the cylindrical body 1 accessible, for example.

Manifestly, minor changes in details of construction can be effected without departing from the spirit and scope of the invention which is defined in, and limited solely by, the appended claims.

I claim:

1. A tubular pen of the type comprising in combination a cylindrical body provided with an axial inner bore, having at its front end a writing tube and an outer surface defining an ink equalizing chamber which is in communication, through at least one transverse bore, with said inner bore which is in turn in communication with an ink supply chamber, said inner bore having therein a fall weight with a cleaning wire protruding into said writing tubule, and further including a casing element with a portion receivably mounted upon said cylindrical body and adapted for sealing said ink equalizing chamber, wherein the improvement comprises: a tubular extension upon said cylindrical body, said extension extending rearwardly and connecting said cylindrical body and said ink supply chamber, said extension in communication with said inner bore and said ink supply chamber, said tubular extension together with said casing element defining means to allow said tubular extension to be moved forward to a limited extent within said casing element to thereby expose said ink equalizing chamber on said outer surface of said cylindrical body, characterized in that the axial length of said tubular extension corresponds approximately to the axial length of said ink equalizing chamber.

2. Tubular pen according to claim 1, characterized in that said means comprises a male thread upon the outer surface of said tubular extension in engagement with a corresponding female thread inside said casing element, wherein said female thread is defined rearwardly of said casing portion adapted for sealing said ink equalizing chamber.

3. Tubular pen according to claim 1 wherein the outside diameter of said tubular extension is smaller than the outside diameter of the surface defining said ink equalizing chamber of said cylindrical body.

4. Tubular pen according to claim 1, wherein said cylindrical outer surface defining said ink equalizing chamber has the form of a truncated cone, widening to said front end, and further said casing portion adapted for sealing said equalizing chamber is an interior surface defining a corresponding truncated cone.

5. Tubular pen according to claim 1, wherein said ink supply chamber is an ink cartridge sealingly attachable to the rear end of said tubular extension.

6. Tubular pen according to claim 1, characterized in that said means comprises a male thread upon the outer surface of said tubular extension in engagement with a corresponding female thread inside said casing element, wherein said female thread is defined rearwardly of said casing portion adapted for sealing said ink equalizing chamber.

7. Tubular pen according to claim 2 wherein the outside diameter of said tubular extension is smaller than the outside diameter of the surface defining said ink equalizing chamber of said cylindrical body.

8. Tubular pen according to claim 2, wherein said cylindrical outer surface defining said ink equalizing chamber has the form of a truncated cone, widening to said front end, and further said casing portion adapted for sealing said equalizing chamber is an interior surface defining a corresponding truncated cone.

9. Tubular pen according to claim 3, wherein said cylindrical outer surface defining said ink equalizing chamber has the form of a truncated cone, widening to said front end, and further said casing portion adapted for sealing said equalizing chamber is an interior surface defining a corresponding truncated cone.

* * * * *